United States Patent [19]

Sumka

[11] Patent Number: 4,678,062

[45] Date of Patent: Jul. 7, 1987

[54] ELEVATOR CAR

[75] Inventor: Elmer H. Sumka, Edison, N.J.

[73] Assignee: Westinghouse Electric Corp., Pittsburgh, Pa.

[21] Appl. No.: 849,250

[22] Filed: Apr. 8, 1986

[51] Int. Cl.[4] ..... B66B 9/00

[52] U.S. Cl. ..... 187/1 R; 340/19 R; 187/130

[58] Field of Search ..... 187/1 R, 29 R; 340/19 R, 21; 312/234, 234.3, 234.4

[56] References Cited

U.S. PATENT DOCUMENTS

| | | | |
|---|---|---|---|
| 2,738,489 | 3/1956 | Border | 340/19 R |
| 3,493,922 | 2/1970 | Laas | 340/19 R |
| 3,807,531 | 4/1974 | Mandel | 187/29 R |
| 4,032,882 | 6/1977 | Mandel et al. | 340/19 R |
| 4,365,691 | 12/1982 | Bevilaqua et al. | 187/1 R |

FOREIGN PATENT DOCUMENTS

| | | | |
|---|---|---|---|
| 648472 | 3/1964 | Belgium | 187/1 R |

*Primary Examiner*—Joseph I. Rolla
*Assistant Examiner*—Kenneth Noland
*Attorney, Agent, or Firm*—D. R. Lackey

[57] ABSTRACT

An elevator car having a cab which includes front, side, and rear walls assembled to define an enclosure on a platform. The front wall defines an entranceway having first and second door jambs. The front wall further defines at least one inner surface. A main car call panel is mounted on the at least one inner surface of the front wall, and a second or auxiliary car call panel is mounted on a selected one of the door jambs. The car call panel inside the car may be arranged for use by the average passenger, while the door jamb mounted car call panel is arranged for use by the handicapped.

9 Claims, 3 Drawing Figures

ELEVATOR CAR

BACKGROUND OF THE INVENTION

1. Field of the Invention

The invention relates in general to elevator systems, and more specifically to the placement of fixtures, such as the car call station or panel, in an elevator car.

2. Description of the Prior Art

U.S. Pat. No. 4,365,691 recognizes the problem of the car call panel in an elevator cab being extremely inaccessible for some passengers, such as the handicapped in general, and more specifically to passengers with limited reaching ability, such as a passenger in a wheelchair. The '691 patent suggests that lowering the car call panel is not a satisfactory solution because it is then difficult for the lower buttons to be seen and reached by the average passenger, especially in a crowded car. The '691 patent discloses orienting the car call buttons on a plane which is at an angle to the vertical inner front wall of the cab.

SUMMARY OF THE INVENTION

Briefly, the present invention is a new and improved elevator car having a cab constructed of front, side and rear walls which define an enclosure. The front wall of the cab defines an opening to the enclosure which has first and second door jambs. The front wall further defines at least one inner surface suitable for receiving a car call panel. A first car call panel is mounted on this at least one inner surface of the front wall, and a second car call panel is mounted on a selected one of the door jambs. In a preferred embodiment of the invention, the second car call panel includes only car call buttons for placing destination calls, in order to minimize the size of the second panel, and it is also preferably located at a lower elevation than the first car call panel. Thus, the second car call panel is easily accessible by the handicapped as they enter the enclosure; a passenger on a wheelchair does not have to maneuver the chair into a tight corner to reach the normal location of the car call panel; the lower elevation of the door jamb mounted car call panel is not a problem for the average passenger as the first car call panel need not be compromised in height in view of the second panel, which also need not be compromised in height; and, a crowded elevator will not be a problem for the handicapped passengers, as they will have already entered their calls at the uncrowded opening, enabling them to immediately position themselves in any available space.

BRIEF DESCRIPTION OF THE DRAWINGS

The invention may be better understood, and further advantages and uses thereof more readily apparent, when considered in view of the following detailed description the exemplary embodiments, taken with the accompanying drawings, in which.

DESCRIPTION OF THE PREFERRED EMBODIMENTS

Figure 1:
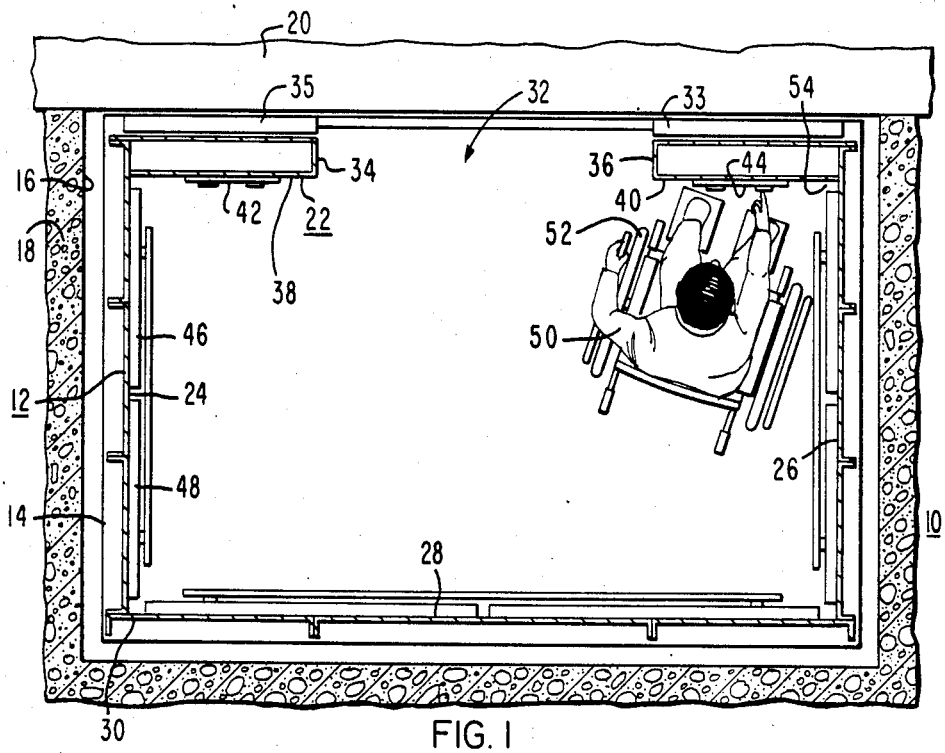
FIG. 1 PRIOR ART
FIG. 1 is a plan view of the inside of an elevator cab, with the fixtures arranged according to the teachings of the prior art, illustrating the problem faced by a handicapped passenger in reaching the car call panel to place a destination call.

Referring now to the drawings, and to FIG. 1 in particular, there is shown an elevator car 10 having a cab 12 mounted on a platform 14 which has car mounted fixtures located according to the teachings of the prior art. Elevator car 10, which may be associated with an elevator system of either the traction or hydraulic type, is mounted for guided vertical movement in the hoistway 16 of a building 18 to serve the floors therein, such as floor 20.

Figure 3:
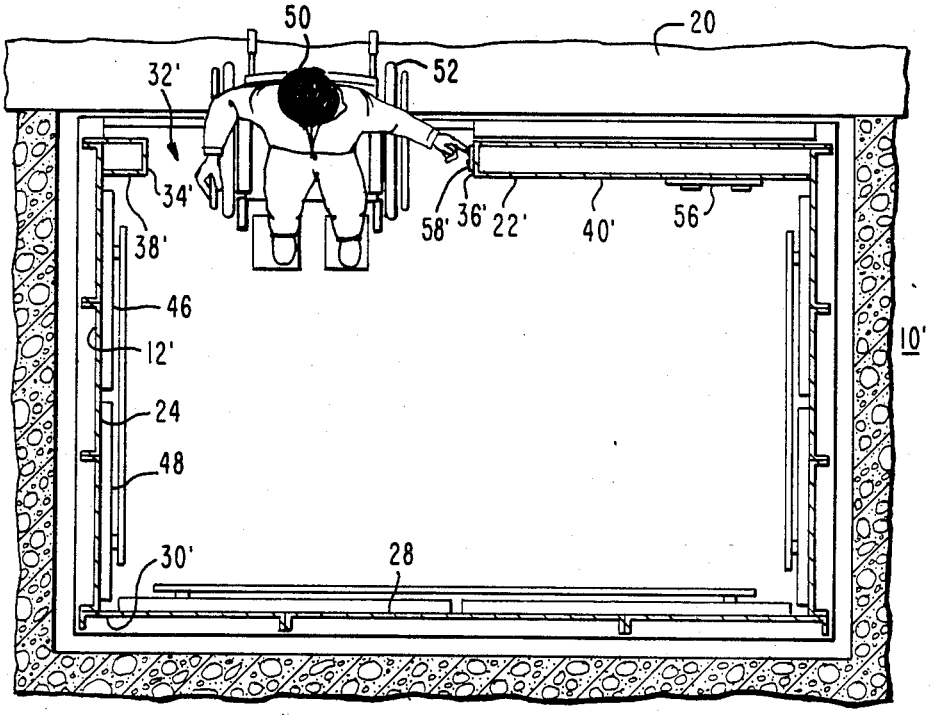
FIG. 3 is a plan view of the inside of an elevator cab illustrating the placement of an auxiliary car call station, according to the teachings of the invention, in an elevator cab having a side entrance through the front wall of the elevator cab.
Figure 2:
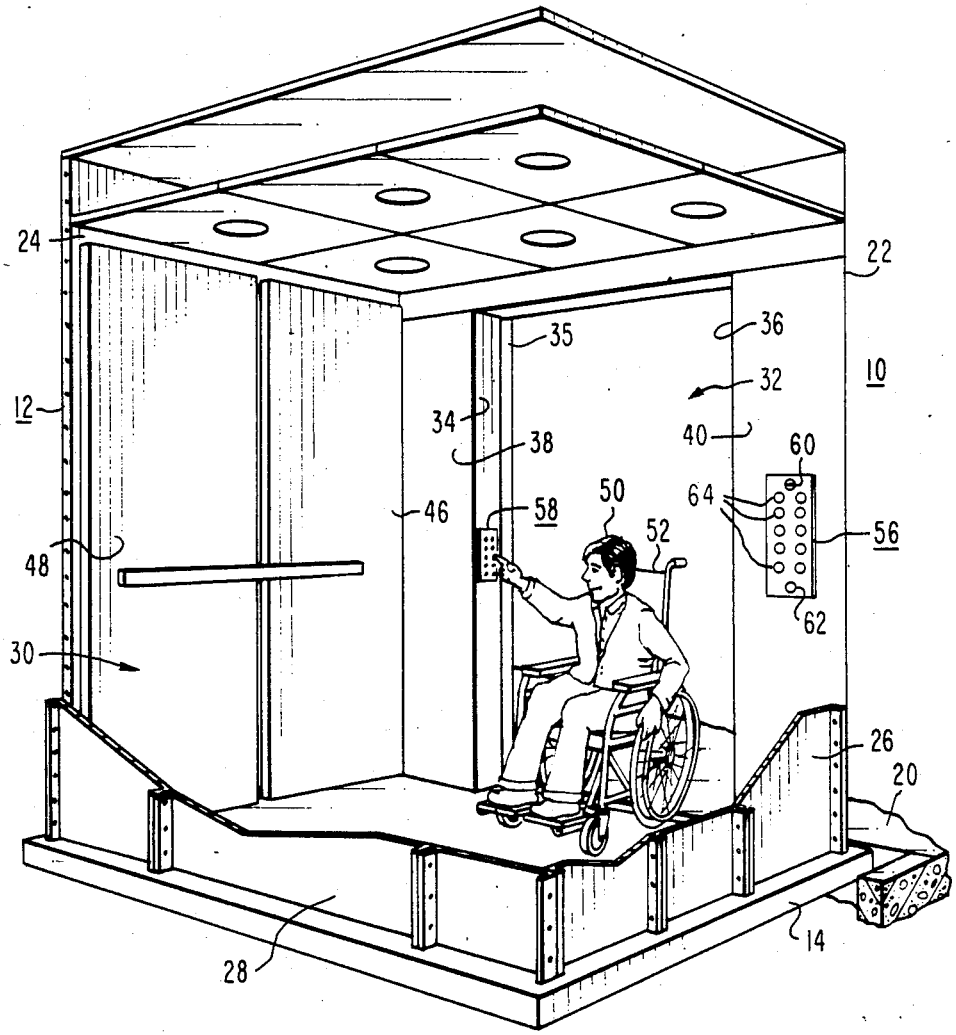
FIG. 2 is a perspective view of an elevator cab, shown partially cut away, illustrating the placement of an auxiliary car call station on a door jamb, according to the teachings of the invention, in an elevator cab having a center entrance through the front wall of the cab.

Cab 12 includes a front wall 22, side walls 24 and 26, and a rear wall 28, assembled on platform 14 to define an enclosure 30. The front wall 22 defines an opening 32, shown as a center opening, having first and second door jambs 34 and 36, respectively. Bi-parting door panels 33 and 35 are mounted for slidable movement adjacent to the front wall 22, to open and close the entranceway 32. The front wall 22 further defines first and second inner vertically oriented planar surfaces 38 and 40, respectively. With a center opening, both inner surfaces 38 and 40 are of a size suitable for receiving a car call panel, and for purposes of example main and auxiliary car call panels 42 and 44 are shown mounted on inner surfaces 38 and 40, respectively. While not utilized in all cab constructions, it is common to hang decorative panel members in the enclosure 30, on the side and rear walls, such as decorative panel members 46 and 48 shown on side wall 24. Thus, it is common for the main and auxiliary car call panels to be mounted on the front wall, which is devoid of decorative panel members. When decorative panel members are not hung on the side walls, the auxiliary car call panel, if used, may be mounted on a side wall, especially when the entrance to the cab is on one side of the front wall, as illustrated in FIG. 3, instead of being centered as shown in FIGS. 1 and 2. A sidewall mounted car call panel would still be a problem for the handicapped in a crowded elevator car.

FIG. 1 includes a handicapped passenger 50 on a wheelchair 52, illustrating the problem of maneuvering the wheelchair 52 into the corner 54 formed by the front wall 22 and the sidewall 26. It is difficult for the passenger 50 to get close enough to the car call panel 44 to place a destination call, even when the cab 12 is not crowded. In a crowded cab, it is virtually impossible for the handicapped passenger to place a destination call, with it usually being placed by some other passenger located near the car call panel.

FIG. 2 is a perspective view of the elevator car 10 shown in FIG. 1, with portions cut away to more clearly show the front wall 22. The car call fixtures in the elevator car 10 shown in FIG. 2 are arranged according to the teachings of the invention. A first or main car call panel 56 is mounted on a selected one of the inner surfaces of the front wall 22, such as inner surface 40, and a second or auxiliary car call panel 58 is mounted on a selected one of the door jambs, such as door jamb 34. With the arrangement shown in FIG. 2, the main and auxiliary car call panels 56 and 58 are mounted on opposite sides of the opening 32. It would also be suitable for the main and auxiliary car call panels 56 and 58 to be mounted on the same side of opening 32, as shown in FIG. 3. For example, the second car call panel 58 may be mounted on door jamb 36, immediately adjacent to the first car call panel 56; or, the first car call panel 56 may be mounted on inner surface 38, immediately adjacent to the location of the second car call panel 58 shown in FIG. 2. Placing the car call panels 56 and 58 on the same side of the door opening would simplify wiring, especially when the call buttons are connected in parallel. If they are placed on opposite sides of the door opening, wiring may be simplified by utilizing the serial interconnection set forth in U.S. Pat. No. 3,807,531, which is assigned to the same assignee as the present invention. The present invention in which a car call panel is mounted on a door jamb may also be utilized when main and auxiliary car call panels are mounted on both inner surfaces 38 and 40 of the front wall 22, as shown in FIG. 1.

Unlike prior art main and auxiliary car call panels, which are usually essentially duplicates of one another, the first and second car call panels 56 and 58 are not of like construction. The first or main car call panel includes control switches and car call or destination pushbuttons. For example, an emergency stop switch 60 and a door-open button 62 are usually provided, in addition to the car call buttons 64. The door jamb mounted car call panel on the other hand, in a preferred embodiment of the invention, is limited to car call or destination buttons, in order to limit its size and enable it to fit on the door jamb. When the associated building has a large number of floors, a telephone type pushbutton arrangement may be used for the door jamb mounted car call entry panel, in which the floor numbers are entered via 10 pushbuttons, regardless of the number of floors. U.S. Pat. No. 3,493,922 is directed to such an arrangement.

Since the first or main car call panel 56 is primarily for use by the average passenger, its height need not be compromised for purposes of the handicapped passenger, and it may thus be located at the normal or conventional height from the floor or platform 14. Also, since the second or door jamb mounted car call panel 58 is primarily for use by the handicapped, its height may be specifically selected for this use. The reference to height is specifically with reference to the location of the uppermost car call buttons. It will be noted from FIG. 2 that the uppermost car call buttons 64 of the first car call panel 56 are located a greater distance from the platform 14 than the call buttons of the door jamb mounted car call panel 58.

FIG. 3 is a plan view of an elevator car 10′ illustrating the teachings of the invention applied to a side opening 32′ in the front wall 22′ of the cab 12′. In this arrangement, the area of inner surface 38′ is too small to accommodate the main car call panel, and thus it will be mounted on the large inner wall 40′. The door jamb mounted car call panel 58′ may be mounted on either door jamb 34′ or 36′, as desired. For purposes of example, FIG. 3 illustrates car call panel 58′ mounted on the same side of entranceway 32′ as the main car call control panel 56.

In summary, there has been disclosed a new and improved elevator car, and more specifically a new and improved arrangement for mounting car call associated fixtures in an elevator car. Mounting a car call panel on the door jamb of the entranceway enables the handicapped to place their destination call in the entranceway, which is always free and open, regardless of the number of passengers already in the car. The door jamb mounted car call panel may be specifically selected for the recommended height for the handicapped, without adversely affecting the ability of the average passenger to place car calls, as the main car call panel inside the cab may be placed at the conventional height. The handicapped may thus enter the cab, placing their destination call as they enter, and then occupy any available space, as there is no need to maneuver a wheelchair into a tight corner of the cab in an attempt to reach the main car call panel.

I claim as my invention:

1. An elevator car, comprising:
   - a cab having side, rear and front walls which define an enclosure,
   - the front wall of said cab defining an opening to said enclosure which includes first and second door jambs,
   - the front wall of said cab further defining at least one inner wall portion inside said enclosure which is immediately adjacent to a predetermined one of said first and second door jambs,
   - door means mounted for sliding motion to open and close the opening to the enclosure,
   - a first car call panel mounted at a location on said at least one inner wall portion of the front wall selected for convenient use by a passenger on foot,
   - and a second car call panel mounted at a predetermined location selected for convenient use by a passenger on a wheelchair, notwithstanding a crowded enclosure,
   - said predetermined location of the second car call panel being on a selected one of the first and second door jambs, such that an elevator call may be registered by a passenger on a wheelchair while still in the opening to the cab enclosure, before the door means closes the enclosure opening, and before the wheelchair passenger is fully within said enclosure.

2. The elevator system of claim 1 wherein the first car call panel includes control buttons, and car call buttons for placing destination calls, and the second car call panel includes only car call buttons for placing destination calls.

3. The elevator system of claim 1 wherein the front wall defines a center opening, and it further defines first and second inner wall portions adjacent to the first and second door jambs, respectively, with the first car call panel being mounted on a selected one of the first and second inner wall portions.

4. The elevator system of claim 3 wherein the first and second car call panels are respectively mounted on the inner wall portion and the door jamb which are located immediately adjacent to one another, on the same side of the opening to the enclosure.

5. The elevator system of claim 3 wherein the first and second car call panels are mounted on opposite sides of the opening to the enclosure.

6. The elevator system of claim 1 including decorative panel members in the enclosure, on the side and rear walls.

7. The elevator system of claim 1 wherein the front wall defines a side opening to the enclosure, with the front wall defining only one inner wall portion suitable for receiving the first car call panel.

8. The elevator system of claim 7 wherein the second car call panel is mounted on the door jamb which is immediately adjacent to the inner wall portion on which the first car call panel is mounted.

9. The elevator system of claim 1 wherein the second car call panel is located at a lower elevation than the first car call panel.

* * * * *